US009675857B2

(12) United States Patent
Ryan

(10) Patent No.: US 9,675,857 B2
(45) Date of Patent: Jun. 13, 2017

(54) APPARATUS FOR TESTING A GOLF CLUB

(71) Applicant: Kevin Ryan, Victoria (AU)

(72) Inventor: Kevin Ryan, Victoria (AU)

( * ) Notice: Subject to any disclaimer, the term of this patent is extended or adjusted under 35 U.S.C. 154(b) by 36 days.

(21) Appl. No.: 14/783,365

(22) PCT Filed: Apr. 11, 2014

(86) PCT No.: PCT/AU2014/000440
§ 371 (c)(1),
(2) Date: Oct. 8, 2015

(87) PCT Pub. No.: WO2014/165942
PCT Pub. Date: Oct. 16, 2014

(65) Prior Publication Data

US 2016/0067572 A1 Mar. 10, 2016

(30) Foreign Application Priority Data

Apr. 12, 2013 (AU) ..... 2013901268

(51) Int. Cl.
*A63B 60/46* (2015.01)
*A63B 60/42* (2015.01)
*A63B 53/00* (2015.01)
*A63B 57/00* (2015.01)

(52) U.S. Cl.
CPC ..... *A63B 60/46* (2015.10); *A63B 53/00* (2013.01); *A63B 57/00* (2013.01); *A63B 60/42* (2015.10)

(58) Field of Classification Search
CPC ..... A63B 60/46
See application file for complete search history.

(56) References Cited

U.S. PATENT DOCUMENTS 3,855,842 A * 12/1974 Imabori ..... G01M 99/00 73/11.01
4,996,867 A 3/1991 Miyamae
5,393,058 A * 2/1995 Rowland ..... A63F 7/0628 273/108.22
5,763,761 A 6/1998 Parente et al.
(Continued)

OTHER PUBLICATIONS

International Search Report for PCT/AU2014/000440, Completed by the Australian Patent Office on Jun. 27, 2014, 4 pages.
(Continued)

*Primary Examiner* — Clayton E LaBalle
*Assistant Examiner* — Dennis Hancock
(74) *Attorney, Agent, or Firm* — Brooks Kushman P.C.

(57) ABSTRACT

An apparatus for testing a golf club. The apparatus holds a golf club, and moves that club through a downswing that extends from an initial position that is at the top of the downswing to at least an impact position in which the golf club head would impact a golf ball. The apparatus includes a support frame, motors, an elongate member, a gripping device for holding a golf club, and a controller. The elongate member has an inner section connected to an outer section by a swivel joint. The gripping device is connected to the outer section by a revolute joint. The controller generates motor drive signals to cause the motors to rotate to effect the downswing such that, during the downswing, the outer section rotates relative to the inner section and the golf club face is in an aligned position when the club head is at the impact position.

20 Claims, 1 Drawing Sheet

(56) References Cited

U.S. PATENT DOCUMENTS

| | | | | |
|---|---|---|---|---|
| 5,908,979 | A | 6/1999 | Miyamae | |
| 8,418,536 | B2 * | 4/2013 | Miyamae | A63B 60/42 73/65.03 |
| 2011/0009204 | A1 * | 1/2011 | Boldin | A63B 69/365 473/229 |
| 2011/0067507 | A1 | 3/2011 | Miyamae | |

OTHER PUBLICATIONS

Youtube link https://www.youtube.com/watch?v=nxVEXFjal11 Uploaded on Feb 17, 2010, Accessed on Jan. 13, 2016, 5 Minutes and 52 Seconds, "Golf Robot-10.wmv".

* cited by examiner

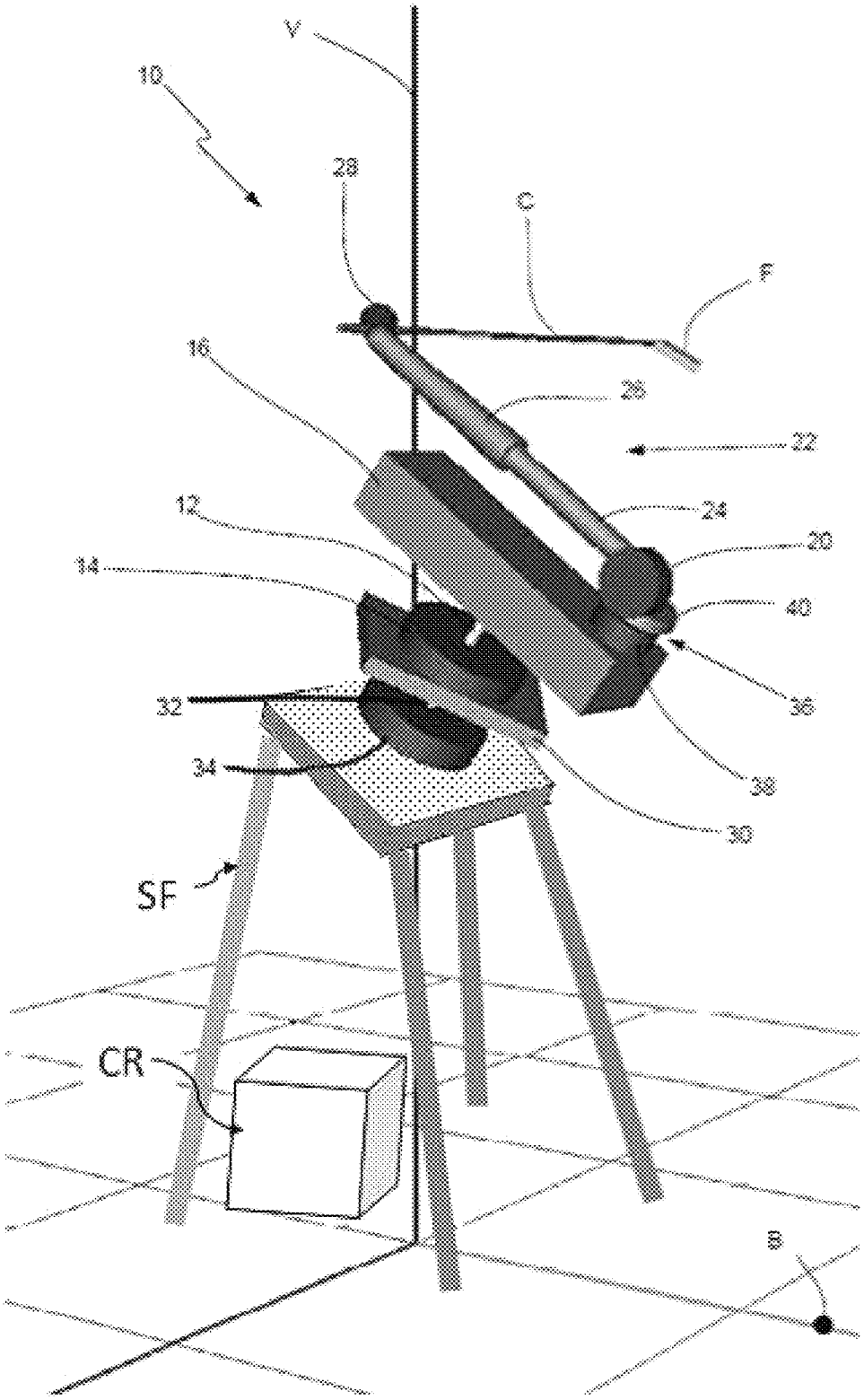
V
10
28
C
F
16
26
22
12
24
14
20
40
32
36
34
38
30
SF
CR
B

APPARATUS FOR TESTING A GOLF CLUB

CROSS-REFERENCE TO RELATED APPLICATION

This application is the U.S. national phase of PCT Application No. PCT/AU2014/000440 filed on Apr. 11, 2014, which claims priority to AU Patent Application No. 2013901268 filed on Apr. 12, 2013, the disclosures of which are incorporated in their entirety by reference herein.

FIELD

The present invention relates to an apparatus for testing a golf club.

BACKGROUND

In golf club design and manufacture, there is a need to physically test the performance of the club in an actual swing. Due to the inherent variability in human movement, it is desirable that tests be performed in a consistent and repeatable manner, and this can be achieved with a golf club testing apparatus.

Known golf club testing apparatus have a support frame that rests on, or is secured to, a ground surface. Various linkages and motors are attached to the support frame, and finish with a gripping device to hold a golf club. The motors are driven to cause the golf club to swing and, in some cases, strike an object such as a golf ball.

The applicability of the results obtained using a golf club testing apparatus to real golfers are highly dependent on the apparatus' swing properties, which are derived from theoretical models of a golf swing. Inaccuracies in the theoretical model reduce the applicability of the results obtained from the apparatus. Consequently, apparent improvements in the results from the apparatus may not lead to improvements in player's performance.

There is a need to provide a golf club testing apparatus that can more accurately replicate an ideal golf swing, and/or at least provides a useful alternative.

SUMMARY

There is provided an apparatus for testing a golf club, the apparatus including:

a support frame that is to be located on a ground surface;

a first shaft that is supported above the ground surface and is rotatable relative about a first axis to the support frame, the first axis being inclined to the vertical;

a first motor that is configured to rotate the first shaft;

a first platform that is connected to the first shaft for rotation with the first shaft;

a second shaft that is rotatable relative to the first platform and is spaced from the first axis, the second shaft being rotatable relative to the first platform about a second axis, the first and second axes being non-parallel;

a second motor that is configured to rotate the second shaft;

an elongate member having an inner section that is connected to the second shaft such that the elongate member rotates about the second axis with rotation of the second shaft, an outer section with an outer end, and a swivel joint that connects the inner and outer sections such that the outer section is rotatable relative to the inner section through a pre-determined range of angles;

a gripping device for holding a golf club, the gripping device being connected to the outer end of the elongate member by a revolute joint; and a controller that is configured to generate a first motor drive signal that is transmitted to the first motor to cause the first shaft to rotate relative to the support frame, and a second motor drive signal that is transmitted to the second motor to cause the elongate member to rotate relative to the first platform, whereby, in use, the apparatus moves the golf club held in the gripping device through a downswing that extends from an initial position to at least an impact position in which the golf club head would impact a golf ball; and the controller is configured or configurable to generate first and second motor drive signals that cause the first and second motors to rotate such that during the downswing:

- the angle between the elongate member and the first axis decreases as the club head approaches the impact position, and
- the outer section rotates relative to the inner section such that, at the impact position, the golf club face is in an aligned position in which the golf club face is perpendicular to the golf club head velocity when the golf club head is at the impact position.

In certain embodiments, the controller is configured to generate first and second motor drive signals that cause the first and second motors to rotate such that the gripping device follows a downward spiral during the downswing.

The swivel joint may allow the outer section to rotate freely relative to the inner section. Alternatively, the swivel joint may have means to resist rotation such that the swivel joint provides resistance to rotation of the outer section relative to the inner section. In these embodiments, rotation of the golf club face into the aligned position is caused by forces external to the elongate member.

In certain embodiments, the apparatus further includes:

a first intermediate platform that is mounted on the first shaft for rotation with the first shaft;

a third shaft on which first platform is mounted, the third shaft being rotatable relative to the first intermediate platform, and being rotatable about the first axis;

a third motor that is configured to rotate the third shaft;

wherein the controller is further configured to generate a third motor drive signal that is transmitted to the third motor to cause the first platform to rotate relative to the first intermediate platform.

Preferably, the controller is configurable to generate third motor drive signals that, in combination with the first and second motor drive signals, causes the first, second and third motors to rotate such that during the downswing the golf club face rotates into an aligned position at the impact position in which the golf club face is perpendicular to the golf club head velocity at the impact position.

Alternatively or additionally, the apparatus can further include:

a fourth shaft that is rotatable relative to the first platform about a third axis, the first and third axes being parallel and spaced apart;

a fourth motor that is configured to rotate the fourth shaft; and a second intermediate platform that is mounted on the fourth shaft for rotation with the fourth shaft, wherein the second shaft that is rotatable relative to the second intermediate platform, and the controller is further configured to generate a fourth motor drive signal that is transmitted to the fourth motor to cause the second intermediate platform to rotate relative to the first platform.

Preferably, the second axis is orthogonal to the third axis.

Preferably, the controller is configurable to generate fourth motor drive signals that, in combination with the first and second, and/or third motor drive signals, causes the first, second and/or third motors and fourth motor to rotate such that during the downswing the golf club face rotates into an aligned position at the impact position in which the golf club face is perpendicular to the golf club head velocity at the impact position.

In certain embodiments, the angle between the elongate member and the first axis decreases by at least 25° during the downswing. Preferably, the angle between the elongate member and the first axis decreases by at least 30° during the downswing. More preferably, the angle between the elongate member and the first axis decreases by approximately 50° during the downswing.

In preferred embodiments, the angle between the elongate member and the shaft of the golf club is no more than 170° as the apparatus moves the golf club through the downswing.

In some embodiments, the first platform is rotatable relative to the support frame through at least a first range of angles that is up to 315°. Preferably, the first range of angles extends from −120° to +195°, in which 0° corresponds with configuration of the apparatus in which a line that passes orthogonally through the first and third axes is perpendicular to a line that passes through the impact position and the first axis.

In some embodiments, the first platform is rotatable relative to the first intermediate platform through at least a second range of angles that is up to 120°.

In some embodiments, the second intermediate platform is rotatable relative to the first platform through at least a third range of angles that is up to 90°. Preferably, the third range of angles extends from −90° to 0°, in which 0° corresponds with configuration of the apparatus in which the elongate member lies in a plane that is perpendicular to a line that passes orthogonally through the first and third axes.

In some embodiments, the elongate member is rotatable relative to the second intermediate platform through at least a fourth range of angles that is up to 140°. Preferably, the fourth range of angles extends from −90° to +50°, in which 0° corresponds with the elongate member being perpendicular to the third axis.

The swivel joint may be rotatable through at least a fifth range of angles that is up to 180°. Preferably, in the fifth range of angles, 0° corresponds with the rotational position of the swivel joint when the golf club face is in the aligned position. Alternatively or additionally, in the fifth range of angles, −90° corresponds with a limit of the rotational position of the swivel joint at the initial position of the downswing.

The revolute joint may be rotatable through at least a sixth range of angles that is up to 90°. Preferably, in the sixth range of angles, 0° corresponds with the rotational position of the revolute joint when the golf club and the elongate member are collinear. Alternatively or additionally, in the sixth range of angles, −45° corresponds with a maximum rotational position of the revolute joint at the initial position of the backswing.

In at least some embodiments, the sixth range of angles is variable between a maximum angular range and a minimum angular range. The minimum angular range can be 0°, such that the minimum angular range corresponds with the revolute joint being fixed in an angular position. Where the sixth range of angles is non-zero, the angular position of the revolute joint at the initial position of the downswing is the lowest angle within the angular range.

In certain embodiments, the apparatus further includes a fifth motor that is configured to rotate the swivel joint in at least one direction, wherein the controller is configured to generate a fifth motor drive signal that is transmitted to the fifth motor, and the fifth motor drive signal causes the fifth motor to rotate the swivel joint from 0° to −90° in the fifth range of angles as the apparatus moves the golf club into the initial position.

In certain embodiments, the apparatus further includes a sixth motor that is configured to rotate the revolute joint in at least one direction, wherein the controller is configured to generate a sixth motor drive signal that is transmitted to the sixth motor, and the sixth motor drive signal causes the sixth motor to rotate the revolute joint from 0° to −45° in the sixth range of angles as the apparatus moves the golf club into the initial position.

The apparatus may further include a spring loaded stopper associated with the revolute joint, and the gripper abuts the stopper when the revolute joint is at the minimum angle within the sixth range of angles. In certain embodiments, the spring loaded stopper has a spring stiffness in the range of 200 to 200000 N/m.

Preferably, the gripper abuts stopper when the apparatus is at the initial position of the downswing.

The gripping device may be configured such that the position of the golf club relative to the gripping device is adjustable. Preferably, the adjustability allows for the position to be adjusted in two planes.

In certain embodiments, the controller generates each motor drive signal generated by the controller is a sigmoid curve to control the respective motor angular position over time during at least the downswing. The sigmoid curve for each motor drive signal is constructed based on one or more of: the start angle for the respective motor angle at the initial position, the maximum angular velocity of the respective motor, and the angle subtended by the respective motor during the downswing.

In some embodiments, the controller can be configured to generate first and second motor drive signals such that each of the first and second motors reaches the respective maximum angular velocity simultaneously.

In embodiments in which the apparatus includes the third motor, the controller can be configured to generate first and third motor drive signals such that the each of the first and third motors reaches the respective maximum angular velocity simultaneously.

In embodiments in which the apparatus includes the fourth motor, the controller can be configured to generate first and third motor drive signals such that the each of the first and fourth motors reaches the respective maximum angular velocity simultaneously.

BRIEF DESCRIPTION OF THE DRAWINGS

In order that the invention may be more easily understood, embodiments will now be described, by way of example only, with reference to the accompanying drawings, in which:

FIG. 1: is a perspective view of a schematic apparatus for testing a golf club according to a first embodiment of the present invention, in which the apparatus is shown at an initial position at the top of a downswing;

FIG. 2: is a perspective view of the apparatus of FIG. 1, in which the apparatus is shown at an intermediate position of the downswing;

FIG. 3: is a perspective view of the apparatus of FIG. 1, in which the apparatus is shown at an impact position;

FIG. 4: is a table of example motor drive signal parameters that govern the motor drive signals for generation by the controller of the apparatus of FIG. 1;

FIG. 5: is a chart of angular position against time for a typical motor drive signal generated by a controller of the apparatus of FIG. 1;

FIG. 6: is a chart of Backswing Total Angle against Downswing Total Angle

FIG. 7: is a perspective view of a schematic apparatus for testing a golf club according to a second embodiment of the present invention, in which the apparatus is shown at an initial position at the top of a downswing;

FIG. 8: is a perspective view of the apparatus of FIG. 7, in which the apparatus is shown at an intermediate position of the downswing; and FIG. 9: is a perspective view of the apparatus of FIG. 7, in which the apparatus is shown at an impact position.

DETAILED DESCRIPTION

FIGS. 1 to 3 show an apparatus 10 for testing a golf club, the apparatus being in accordance with a first embodiment of the present invention. In use, the apparatus 10 is to hold a golf club G, and move that club G through a downswing that extends from an initial position that is at the top of the downswing (which is the position shown in FIG. 1) to at least an impact position in which the golf club head would impact a golf ball (which is the position shown in FIG. 3). In FIGS. 1 to 3, the golf ball B is shown to indicate the impact position.

The apparatus 10 has a support frame SF that is to be located on a ground surface. In the FIGS. 2-9, the support frame SF is omitted for clarity. A first shaft 12 is supported above the ground surface by the support frame SF. The first shaft 12 is rotatable relative to the support frame, and about a first axis that is inclined to vertical. In FIGS. 1 to 3 the vertical direction relative to the ground surface is indicated by reference line V. A first motor 14 is configured to rotate the first shaft 12, and a first platform 16 is connected to the first shaft 12, such that the first platform rotates with the first shaft.

In this embodiment, the apparatus 10 also has a second shaft 18 that is rotatable relative to the first platform 16 about a second axis that is spaced from the first axis. Further, the first and second axes being non-parallel. A second motor 20 is configured to rotate the second shaft 18.

The apparatus 10 has an elongate member 22 with an inner section 24 that is connected to the second shaft 18, and an outer section 26. A swivel joint (not shown) connects the inner and outer sections such that the outer section is rotatable relative to the inner section through a pre-determined range of angles. The elongate member 22 rotates about the second axis with rotation of the second shaft 18.

A gripping device 28 is provided for holding the golf club G. The gripping device 28 is connected to an outer end of the elongate member 22 by a revolute joint (not shown).

As will be appreciated, rotation of the first shaft 12 causes the first platform 14 to rotate. By virtue of the first and second axes being spaced apart, rotation of the first shaft 12 also causes the second shaft to move in a circular arc that is centred on the first axis. Further, rotation of the second shaft 18 by the second motor 20 causes the gripping device 28 to move in a circular arc that is centred on the second axis.

The apparatus 10 includes a controller CR (not shown in FIGS. 2-9) that is configured to generate a first motor drive signal that is transmitted to the first motor 14 to cause the first shaft 12 to rotate relative to the support frame, and a second motor drive signal that is transmitted to the second motor 20 to cause the second shaft 18, and thus the elongate member 22, to rotate relative to the first platform 16. The controller CR is able to generate first and second motor drive signals to move the apparatus such that the golf club G moves through the downswing. Further, the second motor drive signal is to be generated such that during the downswing the angle between the elongate member and the first axis decreases as the club head approaches the impact position.

In FIG. 1, it is evident that the face F of the golf club G is not oriented to strike the ball B at the bottom of the downswing. This is a natural position of the club face F in a golf player's swing. As will be understood, the club face F "closes" (in other words rotates) during the downswing. The controller CR is further configured or configurable to generate first and second motor drive signals that cause the first and second motors to rotate such that during the downswing the golf club face F rotates into an aligned position.

Club head rotation achieved in this manner by an actual golf player—which is absent any torque generated either within the player's elbow or forearm joint in their leading arm, or within the player's wrists—is an action that is defined by the inventor as the "RYKE Effect". Thus, the apparatus 10 is controllable to replicate a golf club swing that incorporates rotation of the club head by virtue of the RYKE Effect.

In the aligned position, the golf club face F is orientated in a perpendicular direction to the golf club head velocity. With appropriate timing of the first and second motor rotational velocities during the downswing, as discussed in further detail below, the golf club face F can be in the aligned position when the club C is at the impact position. The aligned position is evident from FIG. 3.

The swivel joint allows the outer section 26 to rotate relative to the inner section 24. Thus, the rotation of the golf club face F into the aligned position, as described above, is caused by forces external to the elongate member 22. In the apparatus, the rotation of the outer section relative to the inner section does not occur by a biasing or driving force from within elongate member 22.

In the embodiment shown in FIGS. 1 to 3, the apparatus 10 further includes a first intermediate platform 30 that is mounted on the first shaft 12. Rotation of the first shaft 12 causes the first intermediate platform 30 to rotate. The first platform 16 is mounted on a third shaft 32, and the third shaft 32 is rotatable relative to the first intermediate platform 30. Furthermore, the third shaft 32 also rotates about the first axis. Accordingly, both the first and third shafts 12, 32 rotate on a common axis. The apparatus 10 has a third motor 34 that is arranged to rotate the third shaft 32.

The controller CR is configured to generate a third motor drive signal that is transmitted to the third motor 34. The third motor drive signal causes the third shaft 32 to rotate, which causes the first platform 16 to rotate relative to the first intermediate platform 30. As the first and third shafts 12, 32 are arranged in series between the support frame SF and the first platform 16, rotation of either or both the first and third motors 14, 34 can cause the first platform to rotate on the first axis.

In the embodiment shown in FIGS. 1 to 3, the apparatus 10 further includes a fourth shaft 36 that is rotatable relative to the first platform 16 about a third axis. The first and third axes are parallel and spaced apart. In this embodiment, the first axis extends approximately centrally through the first platform 16, and the third axis is located towards an end of the first platform 16. A fourth motor 38 that is configured to rotate the fourth shaft 38. A second intermediate platform 40 is mounted on the fourth shaft 36 for rotation with that shaft. Accordingly, rotation of the fourth shaft 36 by the fourth motor causes the second intermediate platform 40 to rotate relative to the first platform 16.

The second shaft 18 is rotatable relative to the second intermediate platform 40. In this particular embodiment, the second axis is orthogonal to the third axis. In other words, the second shaft 18 and the fourth shaft 36 are orthogonal to one another. Consequently, the elongate member 22 is rotatable about the second and third axes simultaneously.

The controller CR is further configured to generate a fourth motor drive signal that is transmitted to the fourth motor to cause the second intermediate platform to rotate relative to the first platform.

In this particular embodiment, motor drive signals for all four motors 14, 20, 34, 38 can be generated simultaneously by the controller CR to cause the first, second, third and fourth motors 14, 20, 34, 38 to rotate such that with appropriate timing during the downswing the golf club face F rotates into an aligned position at the impact position in which the golf club face F is perpendicular to the golf club head velocity at the impact position. As previously described, the controller CR causes the apparatus 10 to implement a swing that incorporates the RYKE Effect.

It will be apparent that the apparatus 10 of FIGS. 1 to 3 does not have an arrangement to cause the outer section 26 to rotate relative to the inner section 24 during the downswing. Accordingly, it is the relative velocities and timing of the rotations of the four motors 14, 20, 34, 38 that closes the club face during the downswing.

The present inventor has made the surprising discovery that a decrease of the angle between the elongate member 22 and the first axis of at least 25° during the downswing is required to avoid a singularity caused by the swivel and revolute joints interacting in the series configuration of the two joints. A result of avoiding this singularity—by the decreasing angle between the elongate member 22 and the first axis—is rotation of the outer section 26 relative to the inner section 24, which closes the club face F; that is, an implementation of the RYKE Effect. In some situations, decreasing the angle between the elongate member and the first axis by approximately 50° during the downswing is required to close of the club face F. As will be described in further detail below, these changes can be achieved by configuration of the controller CR to generate appropriate motor drive signals.

The present inventor has also made the surprising discovery that a golf swing in which the club face F closes at the impact position can be replicated by configuring the controller CR to generate motor drive signals that cause the four motors 14, 20, 34, 38 to rotate such that the gripping device 28 follows a downward spiral during the downswing.

In the apparatus 10, the angle between the elongate member and the shaft of the golf club is no more than 170° as the apparatus moves the golf club through the downswing. This maximum limit ensures that the singularity previously described is avoided during the downswing.

In this particular embodiment, the first platform 16 is rotatable relative to the support frame SF through at least a first range of angles that is up to 315°. The first range of angles extends from −120° to +195°, in which 0° corresponds with configuration of the apparatus in which a line that passes orthogonally through the first and third axes is perpendicular to a line that passes through the impact position and the first axis.

Further, the first platform 16 is rotatable relative to the first intermediate platform 30 through at least a second range of angles that is up to 120°. In comparing the apparatus 10 with a golfer's movement, the first intermediate platform 30 corresponds with the rotation of the golfer's hips, and the first platform 16 corresponds with the rotation of the golfer's shoulders/torso.

In the apparatus 10, the second intermediate platform 40 is rotatable relative to the first platform 16 through at least a third range of angles that is up to 90°. The third range of angles extends from −90° to 0°, in which 0° corresponds with configuration of the apparatus 10 in which the elongate member 22 lies in a plane that is perpendicular to a line that passes orthogonally through the first and third axes.

Further, the elongate member 22 is rotatable relative to the second intermediate platform 40 through at least a fourth range of angles that is up to 140°. The fourth range of angles extends from −90° to +50°, in which 0° corresponds with the elongate member 22 being perpendicular to the third axis.

In comparing the apparatus 10 with a golfer's movement, the rotation of the second intermediate platform 40 relative to the first platform 16 corresponds with rotation of the golfer's arm at the shoulder joint about an axis that is approximately parallel to their spine; in other words, rotating their arm about their shoulder forward/backward in a golf swing. Rotation of the elongate member 22 relative to the second intermediate platform corresponds with rotation of the golfer's arm at the shoulder joint in a series of planes that are parallel to golfer's spine; in other words, rotating their arm about their shoulder up and down.

In the apparatus 10, the swivel joint is rotatable through a fifth range of angles that is up to 180°. In the fifth range of angles, 0° corresponds with the rotational position of the swivel joint when the golf club face is in the aligned position. In the fifth range of angles, −90° corresponds with a maximum rotational position of the swivel joint at the initial position of the backswing. Thus, the swivel joint corresponds with rotation of a golfer's leading arm at their elbow joint.

Furthermore, in the apparatus 10, the revolute joint is rotatable through a sixth range of angles. In this embodiment, the sixth range of angles is up to 90°. The sixth range of angles extends from −45° to +45°, in which 0° corresponds with the rotational position of the revolute joint when the golf club and the elongate member 22 are collinear, and −45° corresponds with a maximum rotational position of the revolute joint at the initial position of the backswing. Thus, the revolute joint corresponds with rotation of a golfer's leading arm at their wrist joint.

The sixth range of angles can be varied between a maximum angular range and a minimum angular range. In this embodiment, the maximum angular range is 90°, and the minimum angular range is 0°, which corresponds with the gripper being held in a fixed position relative to the elongate member 22. The minimum angular range may correspond with any subset of angles within the maximum angular range. In this way, the gripper (and thus also the golf club G) can be allowed to rotate within the maximum angular range, a restricted angular range, and/or fixed in position relative to the elongate member 22.

FIG. 4 is a table of example motor drive signal parameters that govern the motor drive signals for generation by the controller. For each of the four motors 14, 20, 34, 38, the motor drive signal is governed by parameters that include at least some of:

- a start time, being the time at which rotation of the corresponding shaft is to commence;
- an end time, being the time at which rotation of the corresponding shaft is to conclude;
- a start angle, being the angle of the corresponding shaft within in the respective range at the start time;
- an end angle, being the angle of the corresponding shaft within in the respective range at the end time; and
- the maximum angular velocity to be achieve by the corresponding shaft.

In addition, the signal parameters for each motor can have the option for a delay time, to enable a delay between a common start time, and the time at which rotation of the corresponding shaft is to commence.

FIG. 5 shows a chart of a typical motor drive signal that is generated by the controller. The chart shows angular position ("Angle") on the vertical axis, and time ("Time") on the horizontal axis. As indicated by FIG. 5, each motor drive signal generated by the controller takes the shape of a sigmoid curve, which is constructed based on one or more of parameters listed above. In FIG. 5, each of Calculated Points 1 and 2 are used to determine the shape of the sigmoid curve between the start time/angle and maximum angular velocity, and the maximum angular velocity and the end time/angle. As is evident from FIG. 5, Calculated Points 1 and 2 lie on a tangent line to the maximum angular velocity of the respective motor.

In some situations, in may be desirable to alter the position of Calculated Points 1 and 2 in either angular position or time domain in order to distort the respective sigmoid curve such that the curve is not symmetrical about the angular position corresponding with maximum angular velocity. In other words, the motor drive signal for any motor may be sigmoid-like curve that is not a true sigmoid. Such alterations may be made in order to introduce "disturbances" in the resulting swing of the apparatus, when compared with an "ideal" swing.

The controller can be configured to generate motor drive signals such that the first, second, third and/or fourth motors reach the respective maximum angular velocity simultaneously. In particular, it may be desirable that the first, second and third motors reaches the respective maximum angular velocity simultaneously. Alternatively, controller can be configured to generate motor drive signals such that any of the first, second, third and fourth motors reach the respective maximum angular velocity at a different time to other motors.

The present inventor has made the surprising discovery that the angular rotation of the club face during a downswing that incorporates the RYKE Effect is at least partly dependent on factors that relate to the sum of angular positions of certain shafts at the initial position, and to the sum of angles subtended during the downswing by those shafts. To this end, the first, second and fourth shafts are particularly significant. As discussed previously, these shafts represent the hips, torso and shoulder joint (in the forward/backward direction).

Furthermore, for each apparatus and club combination, each initial angular condition (which is the "backswing total angle", being the sum of angular positions of the first, second and fourth shafts 12, 18, 36) has a unique "downswing" condition that corresponds with the sum of subtended angles (which is the "downswing total angle", being the sum of angles subtended by each of the first, second and third shafts 12, 18, 36 between the initial angular position and the angular position when the club face F is at the impact position).

FIG. 6 is chart showing Backswing Total Angle against Downswing Total Angle. This chart shows a curve U that represents each Backswing Total Angle (the initial angular condition) and its unique Downswing Total Angle (the "downswing" condition) for which the club face F is closed at the impact position. For each Backswing Total Angle, if the Downswing Total Angle exceeds the unique Downswing Total Angle the club face F under-rotates and is not "closed" at the impact position; consequently a sliced swing will result. In the chart of FIG. 6, this is indicated by the region "Slice Zone". If the Downswing Total Angle is less than the unique Downswing Total Angle the club face F over-rotates and "closes" before the impact position; consequently a hooked swing will result. In the chart of FIG. 6, this is indicated by the region "Hook Zone".

It will be appreciated that there are a number of combinations of initial angular positions for each of the first, second and fourth shafts 12, 18, 36 for each Backswing Total Angle. Similarly, there are a number of combinations of subtended angular positions for each of the first, second and fourth shafts 12, 18, 36 for each Downswing Total Angle.

The curve U in FIG. 6 corresponds with an initial member/club condition (at the top of the downswing) in which the angle between the elongate member 22 and the club G is 90°. Alternative initial member/club conditions will each have a unique curve. Thus, there are a family of curves for each initial member/club condition.

In some alternative embodiments, the apparatus may be constructed to have only one motor and shaft between the support frame SF and the first platform. In such an embodiment, the motor drive signal to be generated by the controller to drive that motor may be a sigmoid curve. Alternatively, the motor drive signal to be generated by the controller to drive that motor may be a compound curve of two sigmoid curves.

In some alternative or further embodiments, the apparatus may be constructed to have only one motor and shaft between the first platform and the elongate member. That shaft may be positioned to rotate on a second axis that is inclined to the first axis (about which the shaft(s) between the support frame SF and first platform rotate), such that the angle between the elongate member and the first axis is governed by the orientation of the second axis.

In yet some further alternative embodiments, the apparatus can include a fifth motor that is configured to rotate the swivel joint in at least one direction. In such embodiments, the controller is configured to generate a fifth motor drive signal that is transmitted to the fifth motor, which causes the fifth motor to rotate the swivel joint from 0° to −90° in the fifth range of angles as the apparatus moves the golf club into the initial position. Such embodiments can enable the apparatus to the position of the elongate member through a backswing to the initial position.

Alternatively or additionally, the apparatus can include a sixth motor that is configured to rotate the revolute joint in at least one direction. In such embodiments the controller is configured to generate a sixth motor drive signal that is transmitted to the sixth motor. In instances where the sixth range of angles is non-zero, the sixth motor causes the revolute joint to rotate into the minimum limit within the angular range in the sixth range of angles as the apparatus moves the golf club into the initial position. Such embodiments can enable the apparatus to the position of the gripping device through a backswing to the initial position.

The apparatus may further include a spring loaded stopper associated with the revolute joint. The gripping device abuts the stopper when the revolute joint is at −45° in the sixth range of angles. The spring within the stopper has a spring stiffness in the range of 200 to 200000 N/m. The spring stiffness may be adjustable, if desired. The sixth range of angles can be variable, as described previously.

FIGS. 7 to 9 show an apparatus 110 for testing a golf club, the apparatus being in accordance with a second embodiment of the present invention. Similarly to the apparatus 10 of FIG. 1, in use of the apparatus 110 a golf club G is to be held and moved through a downswing that extends from an initial position that is at the top of the downswing (which is the position shown in FIG. 7) to at least an impact position in which the golf club head would impact a golf ball (which is the position shown in FIG. 9). In FIGS. 7 to 9, the golf ball B is shown to indicate the impact position.

The apparatus 110 has a support frame that is to be located on a ground surface. In FIGS. 2-9, the support frame is omitted for clarity. A first shaft 112 is supported above the ground surface by the support frame. The first shaft 112 is rotatable relative to the support frame, and about a first axis that is inclined to vertical. In FIGS. 7 to 9, the vertical direction relative to the ground surface is indicated by reference line V. A first motor 114 is configured to rotate the first shaft 112, and a first platform 116 is connected to the first shaft 112, such that the first platform 116 rotates with the first shaft 112.

In this embodiment, the apparatus 110 also has a second shaft (which is not visible in the Figures) that is rotatable relative to the first platform 116 about a second axis that is spaced from the first axis. Further, the first and second axes are non-parallel, and in particular, the second axis extends at an angle of 45° to the platform 116. A second motor 120 is configured to rotate the second shaft.

The apparatus 110 has an elongate member 122 with an inner section 124 that is connected to the second shaft, and an outer section 126. A swivel joint (not shown) connects the inner and outer sections such that the outer section is rotatable relative to the inner section through a pre-determined range of angles. The elongate member 122 rotates about the second axis with rotation of the second shaft.

A gripping device 128 is provided for holding the golf club G. The gripping device 128 is connected to an outer end of the elongate member 122 by a revolute joint (not shown).

As will be appreciated, rotation of the first shaft 112 causes the first platform 114 to rotate. By virtue of the first and second axes being spaced apart, rotation of the first shaft 112 also causes the second shaft to move in a circular arc that is centred on the first axis. Further, rotation of the second shaft by the second motor 120 causes the gripping device 128 to move in a circular arc that is centred on the second axis.

The apparatus 110 includes a controller (not shown) that is configured to generate a first motor drive signal that is transmitted to the first motor 114 to cause the first shaft 112 to rotate relative to the support frame, and a second motor drive signal that is transmitted to the second motor 120 to cause the second shaft, and thus the elongate member 122, to rotate relative to the first platform 116. The controller is able to generate first and second motor drive signals to move the apparatus such that the golf club G moves through the downswing. Further, the second motor drive signal is to be generated such that during the downswing the angle between the elongate member and the first axis decreases as the club head approaches the impact position.

Although there are structural differences between the apparatus 10 and the apparatus 110, the two apparatus 10, 110 function in a very similar manner. That is, both apparatus 10, 110 can implement a downswing that incorporates the RYKE Effect, such that the club face F "closes" (in other words, rotates) during the downswing. In the embodiment of FIGS. 7 to 9, the controller is further configured or configurable to generate first and second motor drive signals that cause the first and second motors to rotate such that during the downswing the golf club face F rotates into an aligned position. In the aligned position, the golf club face F is orientated in a perpendicular direction to the golf club head velocity. With appropriate timing of the first and second motor rotational velocities during the downswing, the golf club face F can be in the aligned position when head of the club C is at the impact position.

The first platform 16 is rotatable relative to the support frame through at least a first range of angles that is up to 315°. The first range of angles extends from −120° to +195°, in which 0° corresponds with configuration of the apparatus in which a line that passes orthogonally through the first axis is perpendicular to a line that passes through the impact position and the first axis.

The elongate member 122 is rotatable relative to the platform 116 about the second axis through at least a second range of angles that is up to approximately 90°. In the second range of angles, 0° corresponds with the configuration in which the elongate member is orthogonal to a line that passes through both the first and second axes.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. An apparatus for testing a golf club, the apparatus including:

a support frame that is to be located on a ground surface;

a first shaft that is supported above the ground surface and is rotatable relative about a first axis to the support frame, the first axis being inclined to the vertical;

a first motor that is configured to rotate the first shaft;

a first platform that is connected to the first shaft for rotation with the first shaft; a second shaft that is rotatable relative to the first platform and is spaced from the first axis, the second shaft being rotatable relative to the first platform about a second axis, the first and second axes being non-parallel;

a second motor that is configured to rotate the second shaft;

an elongate member having an inner section that is connected to the second shaft such that the elongate member rotates about the second axis with rotation of the second shaft, an outer section with an outer end, and a swivel joint that connects the inner and outer sections such that the outer section is rotatable relative to the inner section through a pre-determined range of angles;

a gripping device for holding a golf club, the gripping device being connected to the outer end of the elongate member by a revolute joint; and a controller that is configured to generate a first motor drive signal that is transmitted to the first motor to cause the first shaft to rotate relative to the support frame, and a second motor drive signal that is transmitted to the second motor to cause the elongate member to rotate relative to the first platform, whereby, in use, the apparatus moves the golf club held in the gripping device through a downswing that extends from an initial position to at least an impact position in which the golf club head would impact a golf ball; and the controller is configured or configurable to generate first and second motor drive signals that cause the first and second motors to rotate such that during the downswing:

the angle between the elongate member and the first axis decreases as the club head approaches the impact position, and the outer section rotates relative to the inner section such that, at the impact position, the golf club face is in an aligned position in which the golf club face is perpendicular to the golf club head velocity when the golf club head is at the impact position.

2. The apparatus according to claim 1, wherein the controller is configurable to generate first and second motor drive signals that cause the first and second motors to rotate such that the gripping device follows a downward spiral during the downswing.

3. The apparatus according to claim 1, wherein the swivel joint allows the outer section to rotate freely relative to the inner section.

4. The apparatus according to claim 1, further comprising:

a first intermediate platform that is mounted on the first shaft for rotation with the first shaft;

a third shaft on which first platform is mounted, the third shaft being rotatable relative to the first intermediate platform, and being rotatable about the first axis;

a third motor that is configured to rotate the third shaft;

wherein the controller is further configured to generate a third motor drive signal that is transmitted to the third motor to cause the first platform to rotate relative to the first intermediate platform.

5. The apparatus according to claim 4, wherein the controller is configured to generate first and third motor drive signals such that the each of the first and third motors reaches the respective maximum angular velocity simultaneously.

6. The apparatus according to claim 1, wherein the controller is configurable to generate third motor drive signals that, in combination with the first and second motor drive signals, causes the first, second and third motors to rotate such that during the downswing the golf club face rotates into an aligned position at the impact position in which the golf club face is perpendicular to the golf club head velocity at the impact position.

7. The apparatus according to claim 1, further comprising:

a fourth shaft that is rotatable relative to the first platform about a third axis, the first and third axes being parallel and spaced apart;

a fourth motor that is configured to rotate the fourth shaft; and a second intermediate platform that is mounted on the fourth shaft for rotation with the fourth shaft, wherein the second shaft that is rotatable relative to the second intermediate platform, and the controller is further configured to generate a fourth motor drive signal that is transmitted to the fourth motor to cause the second intermediate platform to rotate relative to the first platform.

8. The apparatus according to claim 7, wherein the second axis is orthogonal to the third axis.

9. The apparatus according to claim 7, wherein the controller is configurable to generate fourth motor drive signals that, in combination with the first and second, and/or third motor drive signals, causes the first, second and/or third motors, and fourth motors to rotate such that during the downswing the golf club face rotates into an aligned position at the impact position in which the golf club face is perpendicular to the golf club head velocity at the impact position.

10. The apparatus according to claim 7, wherein the second intermediate platform is rotatable relative to the first platform through at least a third range of angles that is up to 90°.

11. The apparatus according to claim 7, wherein the elongate member is rotatable relative to the second intermediate platform through at least a fourth range of angles that is up to 140°.

12. The apparatus according to claim 7, wherein the controller is configured to generate first and third motor drive signals such that the each of the first and fourth motors reaches the respective maximum angular velocity simultaneously.

13. The apparatus according to claim 1, wherein the angle between the elongate member and the first axis decreases by at least 25° during the downswing.

14. The apparatus according to claim 1, wherein the first platform is rotatable relative to the support frame through at least a first range of angles that is up to 315°.

15. The apparatus according to claim 1, wherein the swivel joint is rotatable through at least a fifth range of angles that is up to 180°.

16. The apparatus according to claim 1, wherein the revolute joint is rotatable through at least a sixth range of angles that is up to 90°.

17. The apparatus according to claim 1, wherein the gripping device is configured such that the position of the golf club relative to the gripping device is adjustable.

18. The apparatus according to claim 1, wherein the controller generates each motor drive signal generated by the controller is a sigmoid curve to control the respective motor angular position over time during at least the downswing.

19. The apparatus according to claim 18, wherein the sigmoid curve for each motor drive signal is constructed based on one or more of: the start angle for the respective motor angle at the initial position, the maximum angular velocity of the respective motor, and the angle subtended by the respective motor during the downswing.

20. The apparatus according to claim 1, wherein the controller is configured to generate first and second motor drive signals such that each of the first and second motors reaches the respective maximum angular velocity simultaneously.

* * * * *